US007187346B2

(12) United States Patent
Kang et al.

(10) Patent No.: US 7,187,346 B2
(45) Date of Patent: Mar. 6, 2007

(54) METHOD FOR DRIVING PLASMA DISPLAY PANEL

(75) Inventors: Seong Ho Kang, Daegu (KR); Sang Jin Yun, Pohang-shi (KR)

(73) Assignee: LG Electronics Inc., Seoul (KR)

( * ) Notice: Subject to any disclaimer, the term of this patent is extended or adjusted under 35 U.S.C. 154(b) by 111 days.

(21) Appl. No.: 10/630,720

(22) Filed: Jul. 31, 2003

(65) Prior Publication Data

US 2004/0021657 A1 Feb. 5, 2004

(30) Foreign Application Priority Data

Aug. 1, 2002 (KR) ..... 10-2002-0045605

(51) Int. Cl.
*G09G 3/10* (2006.01)

(52) U.S. Cl. ..... 345/60; 345/76

(58) Field of Classification Search ..... 315/169.3, 315/169.4; 345/60, 76
See application file for complete search history.

(56) References Cited

U.S. PATENT DOCUMENTS 5,670,974 A 9/1997 Ohba et al.
6,188,374 B1 * 2/2001 Moon ..... 345/60
6,295,040 B1 9/2001 Nhan et al.
6,483,491 B1 11/2002 Lee
6,621,230 B2 * 9/2003 Lim et al. ..... 315/169.3
2002/0105278 A1 8/2002 Kanazawa

FOREIGN PATENT DOCUMENTS

JP 2001-076631 3/2001
JP 2001228820 8/2001
KR 20000073134 A 5/2000

* cited by examiner

*Primary Examiner*—David Vu
(74) *Attorney, Agent, or Firm*—Fleshner & Kim, LLP

(57) ABSTRACT

A method of driving a plasma display panel that is adaptive for improving a picture quality. In the method, first and second sustain pulses having a different width during the sustain period are alternately applied to the first and second row electrodes.

24 Claims, 10 Drawing Sheets

METHOD FOR DRIVING PLASMA DISPLAY PANEL

BACKGROUND OF THE INVENTION

1. Field of the Invention

This invention relates to a plasma display panel, and more particularly to a method of driving a plasma display panel that is adaptive for improving a picture quality.

2. Description of the Related Art

Generally, a plasma display panel (PDP) excites and radiates a phosphorus material using an ultraviolet ray generated upon discharge of an inactive mixture gas such as He+Xe, Ne+Xe or He+Ne+Xe, to thereby display a picture. Such a PDP is easy to be made into a thin-film and large-dimension type. Moreover, the PDP provides a very improved picture quality owing to a recent technical development.

FIG. 1 is a perspective view showing a structure of a conventional alternating current (AC) surface-discharge PDP.

Referring to FIG. 1, a discharge cell of the conventional three-electrode, AC surface-discharge PDP includes a scan electrode 12Y and a sustain electrode 12Z provided on an upper substrate 10, and an address electrode 20X provided on a lower substrate 18.

On the upper substrate 10 provided with the scan electrode 12Y and the sustain electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a phosphorous material 26. The address electrode 20X is formed in a direction crossing the scan electrode 12Y and the sustain electrode 12Z. The barrier rib 24 is formed in parallel to the address electrode 20X to thereby prevent an ultraviolet ray and a visible light generated by a discharge from being leaked to the adjacent discharge cells. The phosphorous material 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Referring to FIG. 2, the conventional AC surface-discharge PDP includes a PDP 30 arranged in a matrix type such that mxn discharge cells are connected to scan electrode lines Y1 to Ym, sustain electrode lines Z1 to Zm and address electrode lines X1 to Xn, a scan driver 32 for driving the scan electrode lines Y1 to Ym, a sustain driver 34 for driving the sustain electrode lines Z1 to Zm, and first and second address drivers 36A and 36B for making a divisional driving of odd-numbered address electrode lines X1, X3, . . . , Xn−3, Xn−1 and even-numbered address electrode lines X2, X4, . . . , Xn−2, Xn. The scan driver 32 sequentially applies a scan pulse and a sustain pulse to the scan electrode lines Y1 to Ym, to thereby sequentially scan discharge cells 1 for each line and sustain a discharge at each of the mxn discharge cells 1. The sustain driver 34 applies a sustain pulse to all the sustain electrode lines Z1 to Zm. The first and second address drivers 36A and 36M apply image data to the address electrode lines X1 to Xn in such a manner to be synchronized with a scan pulse. The first address driver 36A applies image data to the odd-numbered address electrode lines X1, X3, . . . , Xn−3, Xn−1 while applying image data to the even-numbered address electrode lines X2, X4, . . . , Xn−2, Xn.

The AC surface-discharge PDP driven as mentioned above requires a high voltage more than hundreds of volts for an address discharge and a sustain discharge. Accordingly, in order to minimize a driving power required for the address discharge and the sustain discharge, the scan driver 32 and the sustain driver is additionally provided with an energy recovering apparatus 38 as shown in FIG. 3. The energy recovering apparatus 38 recovers a voltage charged in the scan electrode line Y and the sustain electrode line Z and re-uses the recovered voltage as a driving voltage for the next discharge.

Such a conventional driving apparatus 38 includes an inductor L connected between a panel capacitor Cp and a source capacitor Cs, and first and third switches S1 and S3 connected, in parallel, between the source capacitor Cs and the inductor L. A scan/sustain driver 32 is comprised of second and fourth switches S2 and S4 connected, in parallel, between the panel capacitor Cp and the inductor L. The panel capacitor Cp is an equivalent expression of a capacitance formed between the scan electrode line Y and the sustain electrode line Z. The second switch S2 is connected to a sustain voltage source Vsus while the fourth switch S4 is connected to a ground voltage source GND. The source capacitor Cs recovers and charges a voltage charged in the panel capacitor Cp upon sustain discharge and re-supply the charged voltage to the panel capacitor Cp. The source capacitor Cs has a large capacitance value such that it can charge a voltage Vsus/2 equal to a half value of the sustain voltage Vsus. The first to fourth switches S1 to S4 controls a flow of current. The energy recovering apparatus 38 provided at the sustain driver 34 are formed around the panel capacitor Cp symmetrically with the scan driver 32.

FIG. 4 is a timing diagram and a waveform diagram representing on/off timings of the switches shown in FIG. 3 and an output waveform of the panel capacitor.

An operation procedure of the energy recovering apparatus 38 shown in FIG. 3 will be described in conjunction with FIG. 4.

First, it is assumed that a voltage charged between the scan electrode line Y and the sustain electrode line Z, that is, a voltage charged in the panel capacitor Cp prior to the T1 period should be 0 volt, and a voltage Vsus/2 has been charged in the source capacitor Cs. In the T1 period, the first switch S1 is turned on, to thereby form a current path extending from the source capacitor Cs, via the first switch S1 and the inductor L, into the panel capacitor Cp. At this time, the inductor L and the panel capacitor L forms a serial resonance circuit. Since a voltage Vsus/2 has been charged in the source capacitor Cs, a voltage of the panel capacitor Cp rises into a sustain voltage Vsus equal to twice the voltage of the source capacitor Cs with the aid of a current charge/discharge of the inductor L in the serial resonance circuit.

In the T2 period, the second switch S2 is turned on to thereby apply the sustain voltage Vsus to the scan electrode line Y. The sustain voltage Vsus applied to the scan electrode line Y prevents a voltage of the panel capacitor Cp from falling into less than the sustain voltage Vsus to thereby cause a normal sustain discharge. Since a voltage of the panel capacitor Cp has risen into the sustain voltage Vsus in the T1 period, a driving power supplied from the exterior for the purposing of causing the sustain discharge is minimized.

In the T3 period, the first switch S1 is turned off and the panel capacitor Cp keeps the sustain voltage Vsus. In the T4 period, the second switch S2 is turned off while the third switch S3 is turned on. If the third switch S3 is turned on, then a current path extending from the panel capacitor Cp, via the inductor L and the third switch S3, into the source capacitor Cs is formed to thereby recover a voltage charged in the panel capacitor Cp into the source capacitor Cs. While the panel capacitor Cp is discharged, a voltage of the panel capacitor Cp falls. At the same time, a voltage Vsus/2 is charged in the source capacitor Cs. After a voltage Vsus/2 was charged in the source capacitor Cs, the third switch S3 is turned off while the fourth switch S4 is turned on. In the fifth period when the fourth switch S4 is turned on, a current path extending from the panel capacitor Cp into the ground voltage source GND, thereby allowing a voltage of the panel capacitor Cp to falls into 0 volt. In the T6 period, a state in the T5 period is kept for a certain time as it is. An AC driving pulse applied to the scan electrode line Y and the sustain electrode line Z is obtained by periodically repeating an operation procedure in the T1 to T6 periods.

The scan electrode lines Y of the PDP driven in this manner are supplied with a sustain pulse in the sustain period, and are additionally supplied with a reset pulse and a scan pulse in the initialization period and the address period, respectively. Accordingly, the scan driver 32 is provided with a plurality of scan drive integrated circuits and a plurality of high-voltage switches. On the other hand, since the sustain pulse only is supplied, the sustain electrode line Z is directly connected to the sustain driver 34. As a result, a resistance of the current path at the scan driver 32 and the scan electrode line Y becomes larger than that of the current path at the sustain driver 34 and the sustain electrode line Z. Further, the scan driver 32 has a smaller current supply capability than the sustain driver 34.

In spite of such a resistance different of the current path and such a difference in the current supply capability, pulse widths TP1 and TP2 of a first sustain pulse SUS1 and a second sustain pulse SUS2 applied to the scan electrode line Y and the sustain electrode line Z during the sustain period, respectively are equal to each other as shown in FIG. 5. In other words, a rising edge Tr1 of the first sustain pulse SUS1 is identical to a rising edge Tr2 of the second sustain pulse SUS2, and a falling edge Tf1 of the first sustain pulse SUS1 is identical to a falling edge of Tf2 of the second sustain pulse SUS2. Herein, the rising edges Tr1 and Tr2 of the first and second sustain pulses are time intervals going from an operation time of the energy recovering apparatus 38 shown in FIG. 3 until a turning-on time of the second switch S2 while the falling edges Tf1 and Tf2 thereof are time intervals going from an operation time of the energy recovering apparatus 38 into the fourth switch S4.

Accordingly, intensities of sustain discharges caused by the first and second sustain pulses SUS1 and SUS2 applied to the scan electrode line Y and the sustain electrode line Z, respectively are differentiated to raises problems of an irregular discharge and hence a deterioration of picture quality. Particularly, such problems become more serious when a width of each of the first and second sustain pulses SUS1 and SUS2 is approximately 2 μs as a resolution is larger.

SUMMARY OF THE INVENTION

Accordingly, it is an object of the present invention to provide a method of driving a plasma display panel that is adaptive for improving a picture quality.

In order to achieve these and other objects of the invention, a method of driving a plasma display panel according to an embodiment of the present invention, having first and second row electrodes and a heat electrode and including a sustain period for implementing a gray scale depending upon a discharge frequency, includes the step of alternately applying first and second sustain pulses having a different width during the sustain period to the first and second row electrodes.

In the method, a resistance going from a first driver generating the first sustain pulse into the first row electrode is different from a resistance going from a second driver generating the second sustain pulse into the second row electrode.

Herein, said resistance going from the first driver into the first row electrode is larger than a resistance going from the second driver into the second row electrode.

A width of the first sustain pulse is longer than that of the second sustain pulse.

A sustain period of the first sustain pulse is longer than that of the second sustain pulse.

A rising edge caused by an energy recovering circuit of the first sustain pulse is shorter than a rising edge caused by the energy recovering circuit of the second sustain pulse.

Alternatively, a resistance going from the second driver into the second row electrode is larger than a resistance going from the first driver into the first row electrode.

A width of the second sustain pulse is longer than that of the first sustain pulse.

A sustain period of the second sustain pulse is longer than that of the first sustain pulse.

A rising edge caused by an energy recovering circuit of the second sustain pulse is shorter than a rising edge caused by the energy recovering circuit of the first sustain pulse.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 6:
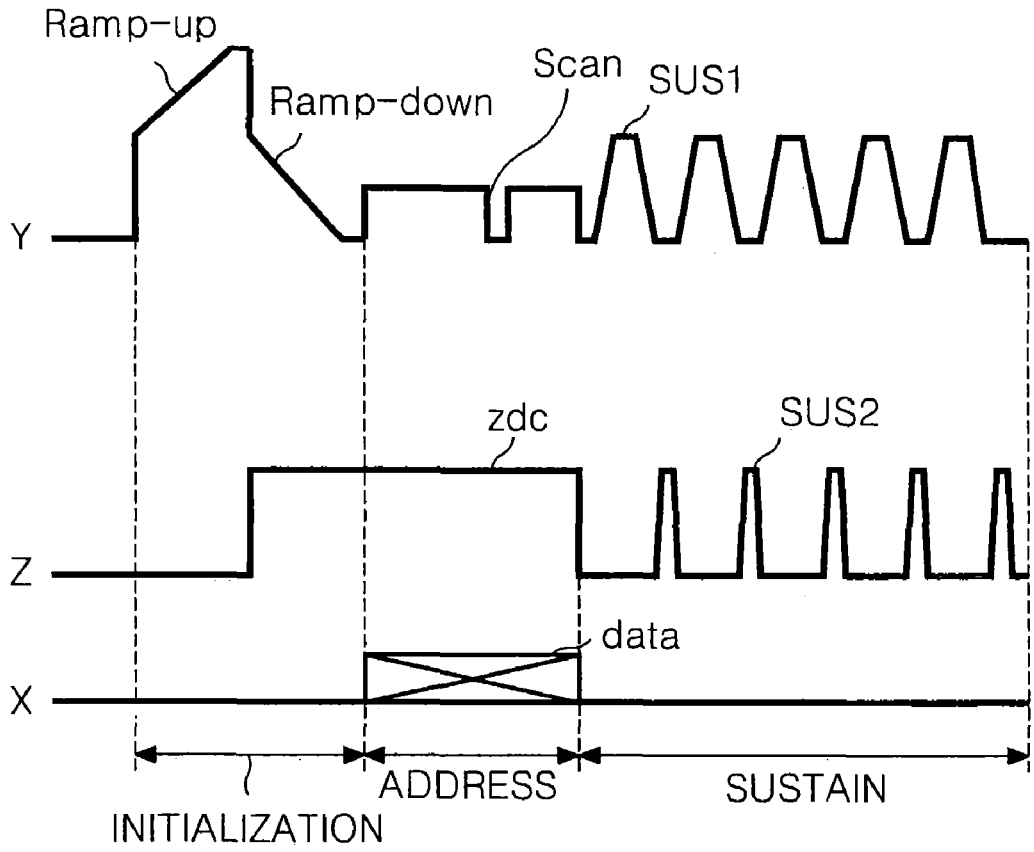
FIG. 6 is a waveform diagram for explaining a method of driving a plasma display panel according to an embodiment of the present invention.

FIG. 6 shows a method of driving a plasma display panel according to an embodiment of the present invention.

Referring to FIG. 6, each sub-field is divided into an initialization period for initializing cells of the entire field, and a sustain period for implementing a gray scale depending upon an address period for selecting a discharge cell and a discharge frequency.

In the initialization period, a rising ramp waveform Ramp-up generated at the scan driver is simultaneously applied to all the scan electrodes. The rising ramp waveform Ramp-up causes a weak discharge within cells of the entire field to thereby generate wall charges within the cells. After the rising ramp waveform Ramp-up was applied, a falling ramp waveform Ramp-down is simultaneously applied to the scan electrodes Y. The falling ramp waveform Ramp-down causes a weak erasure discharge with the cells, to thereby uniformly left wall charges required for the address discharge within the cells of the entire field.

In the address period, a negative scan pulse Scan is sequentially applied to the scan electrodes Y and, at the same time, a positive data pulse data is applied to the address electrodes X. An address discharge is generated within the cells to which the scan pulse Scan and the data pulse data are applied. Wall charges are generated within the cells selected by the address discharge. A positive direct current (DC) voltage zdc is applied to the sustain electrodes Z in the set-down period and the address period.

In the sustain period, the first and second sustain pulses SUS1 and SUS2 are alternately applied to the scan electrodes Y and the sustain electrodes Z. The cell selected by the address discharge causes a sustain discharge taking a surface-discharge type between the scan electrode Y and the sustain electrode Z whenever each of the sustain pulses SUS1 and SUS2 is applied while the wall charges within the cell being added to the sustain pulses SUS1 and SUS2.

Widths of the first and second sustain pulses SUS1 and SUS2 applied to the scan electrode Y and the sustain electrode Z, respectively are differentiated. This will be described in detail with reference to FIG. 7A to FIG. 8B.

Figure 7A:
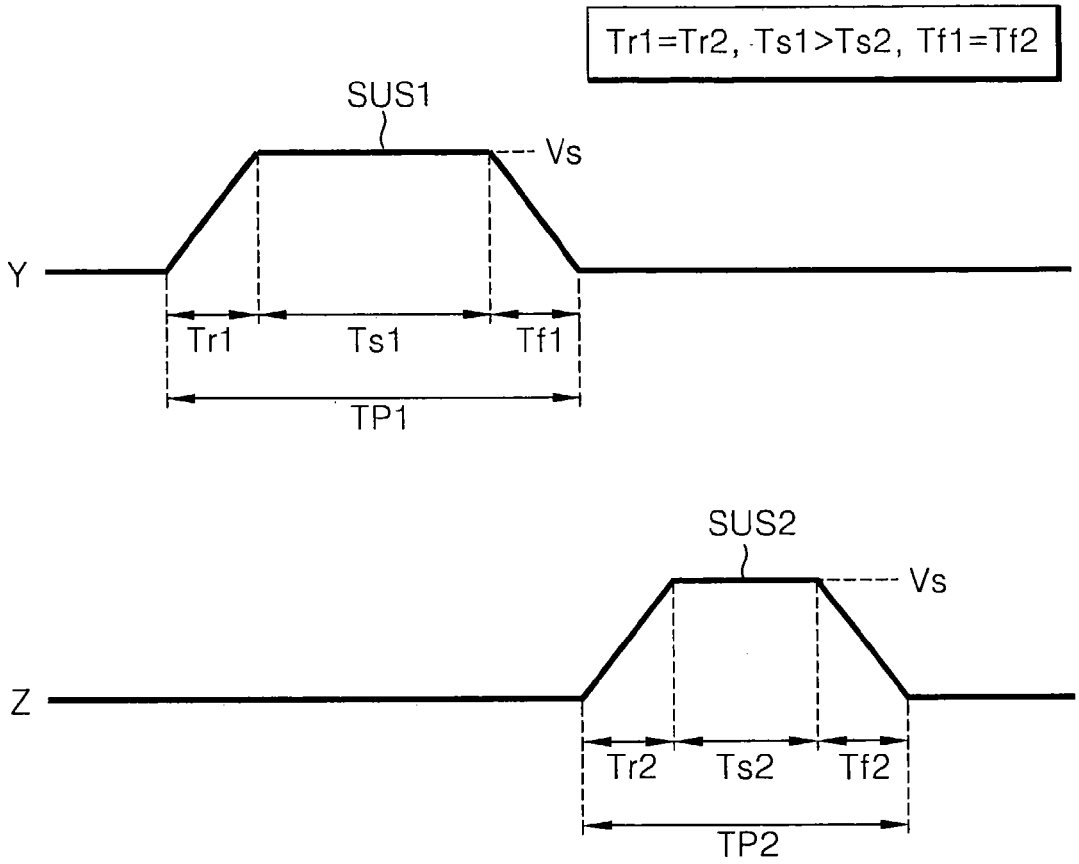
FIG. 7A and FIG. 7B are detailed waveform diagrams of the first and second sustain pulses in the sustain period shown in FIG. 6.
Figure 7B:
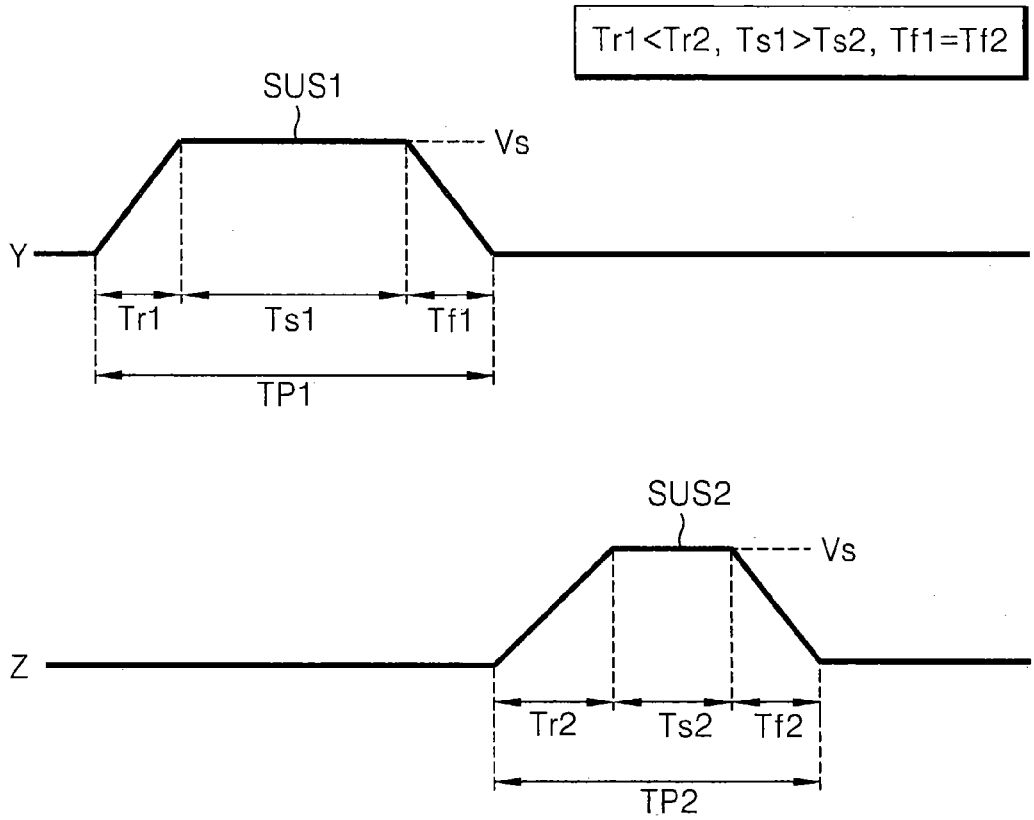

FIG. 7A and FIG. 7B show a sustain pulse applied when a resistance of the current path extending from the scan driver into the scan electrode line Y is smaller than that of the current path extending from the sustain driver into the sustain electrode line Z.

Figure 8A:
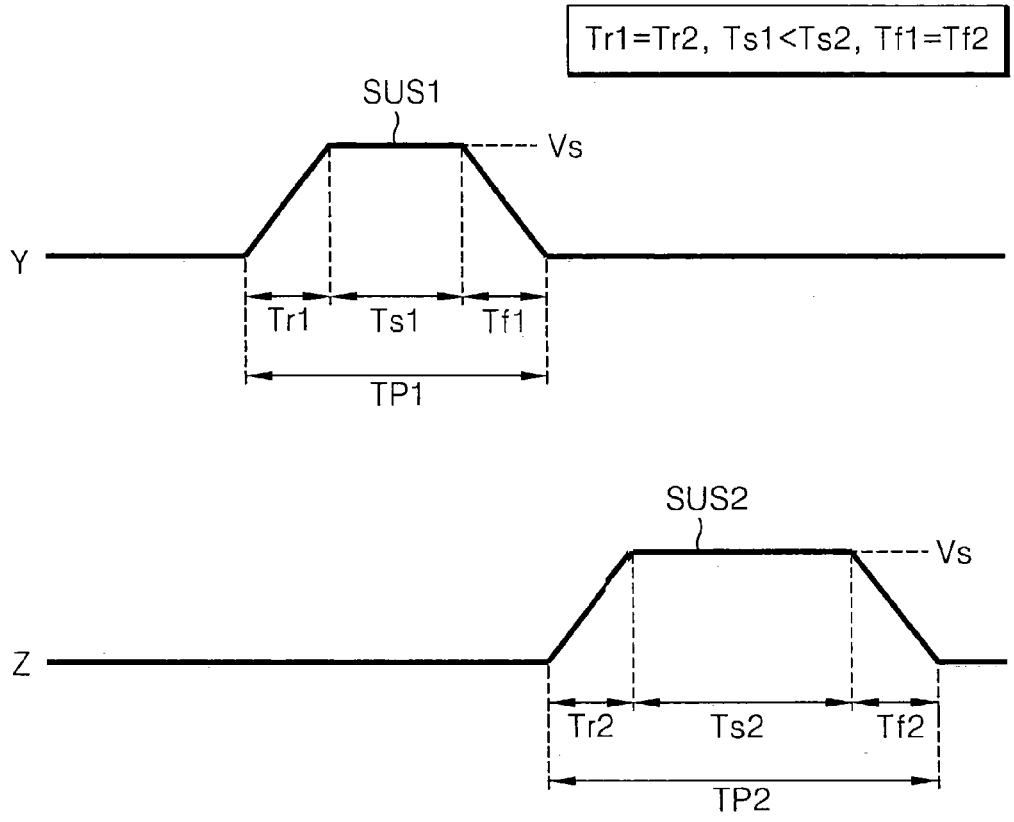
FIG. 8A and FIG. 8B are detailed waveform diagrams showing another shapes of the first and second sustain pulses in the sustain period shown in FIG. 6.
Figure 8B:
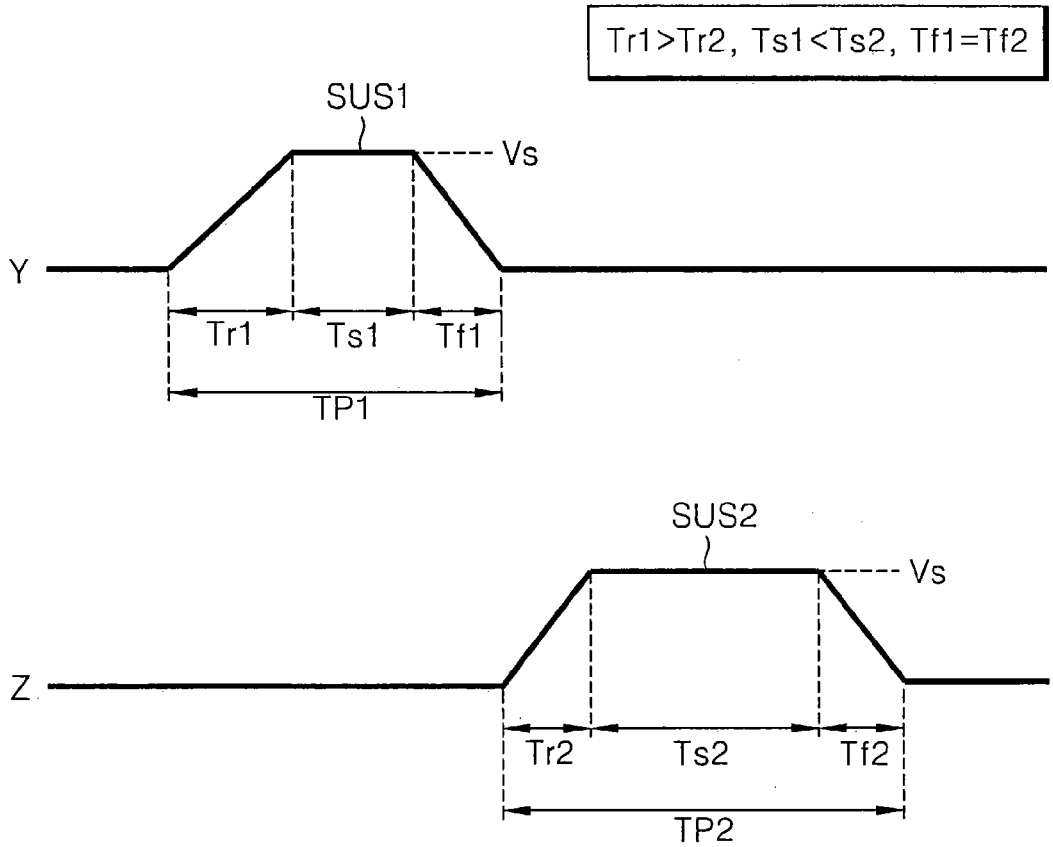

Referring to FIG. 8A and FIG. 8B, a width TP1 of the first sustain pulse SUS1 applied to the scan/sustain electrode line Y is smaller than a width TP2 of the second sustain pulse SUS2 applied to the sustain electrode line Z.

As shown in FIG. 8A, a rising edge Tr1 of the first sustain pulse SUS1 is identical to a rising edge Tr2 of the second sustain pulse SUS2; a sustain interval Ts1 of the first sustain pulse SUS1 is shorter than a sustain interval Ts2 of the second sustain pulse SUS2; and a falling edge Tf1 of the first sustain pulse SUS1 is identical to a falling edge Tf2 of the second sustain pulse SUS2.

Figure 1:
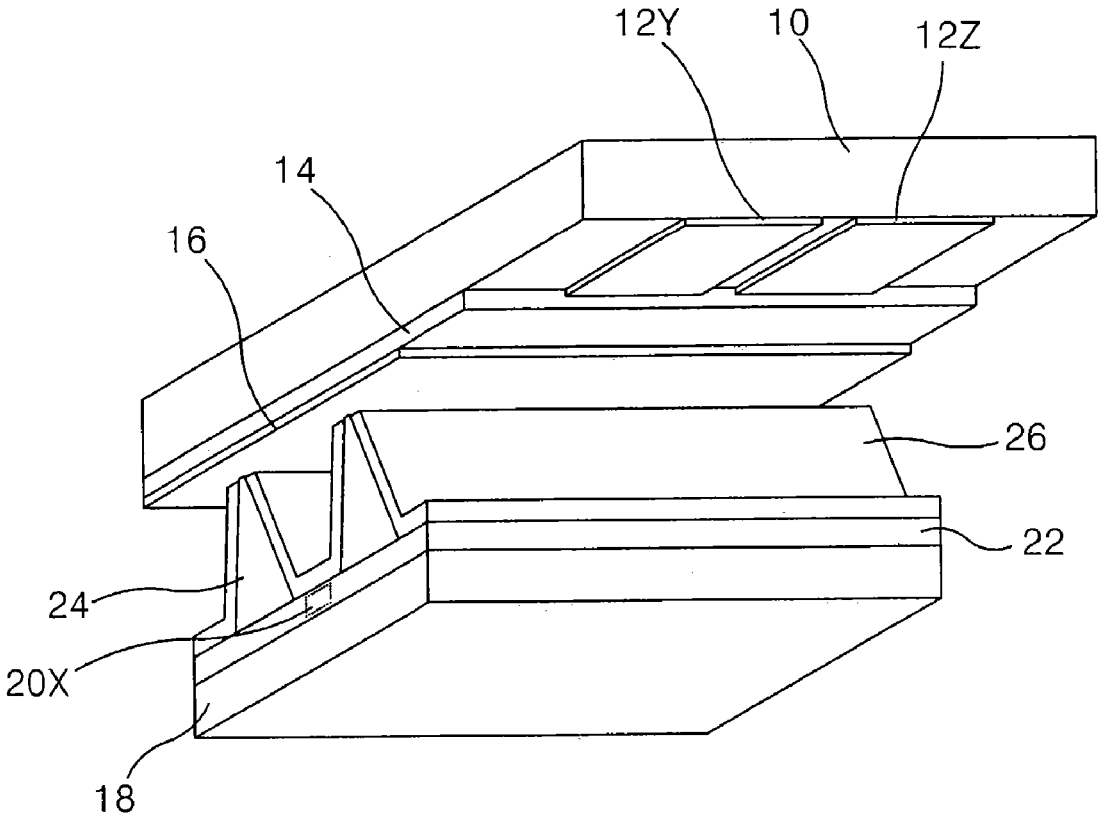
FIG. 1 RELATED ART
FIG. 1 is a perspective view representing a structure of a conventional AC surface-discharge plasma display panel.
Figure 2:
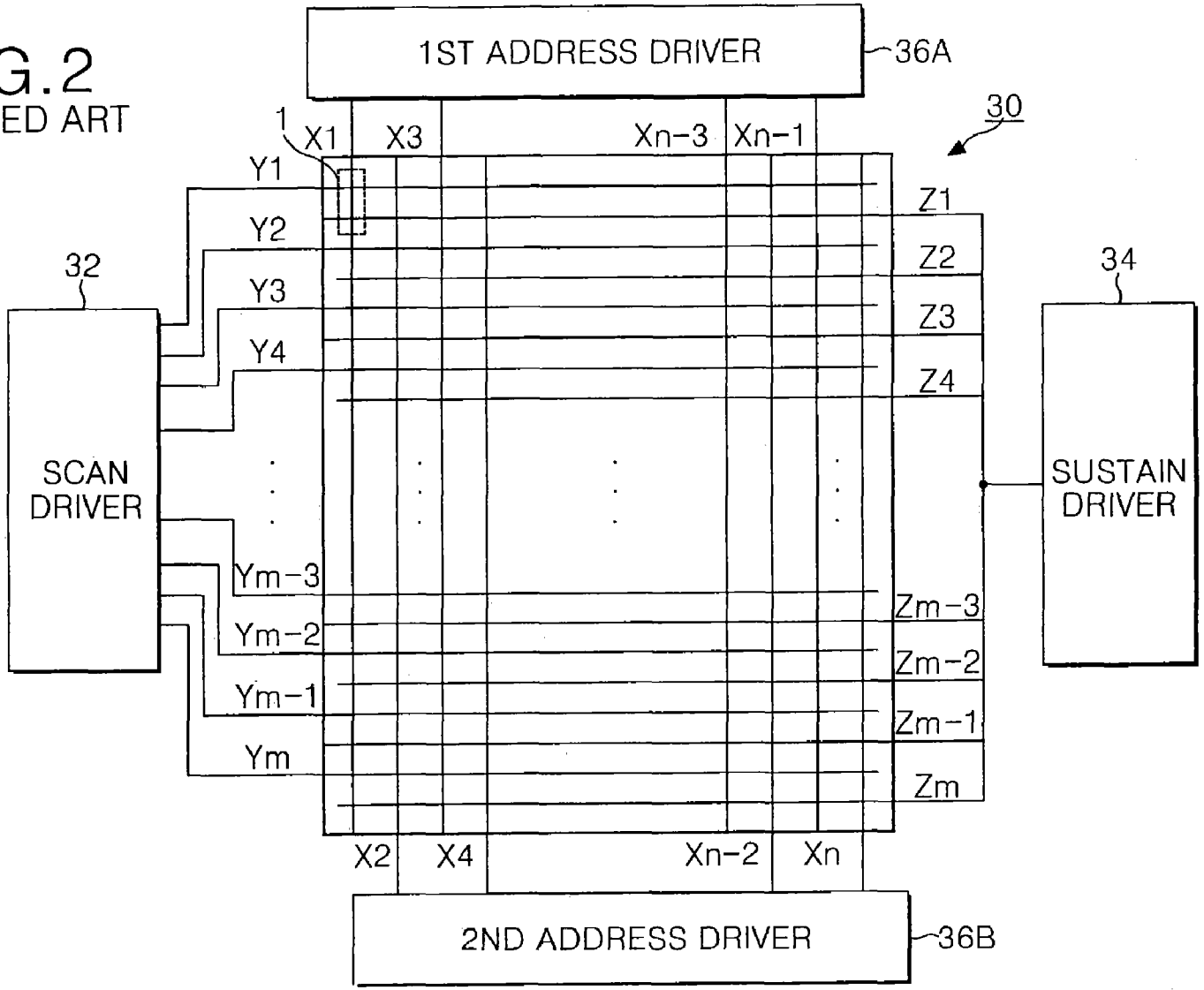
FIG. 2 RELATED ART
FIG. 2 is a plan view showing an arrangement structure of overall electrode lines and discharge cells of the plasma display panel in FIG. 1.
Figure 3:
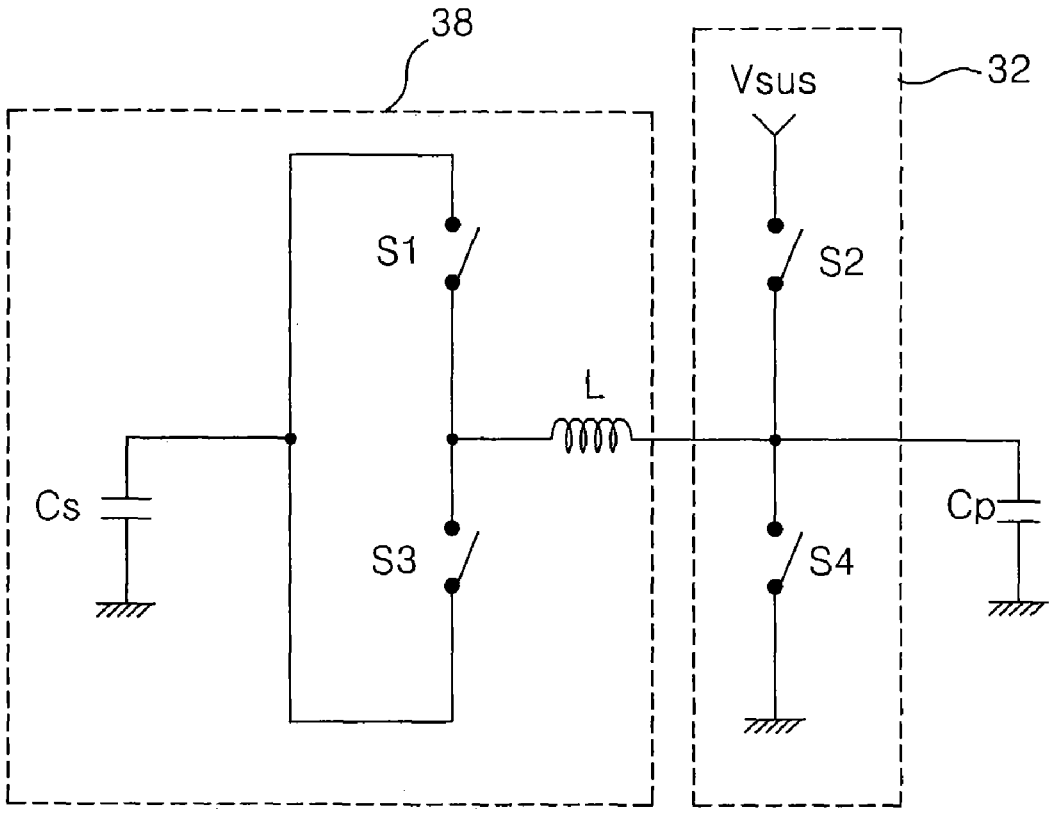
FIG. 3 RELATED ART
FIG. 3 is a circuit diagram of a conventional energy recovering apparatus provided at the pre-stage of the sustain driver in FIG. 2.
Figure 4:
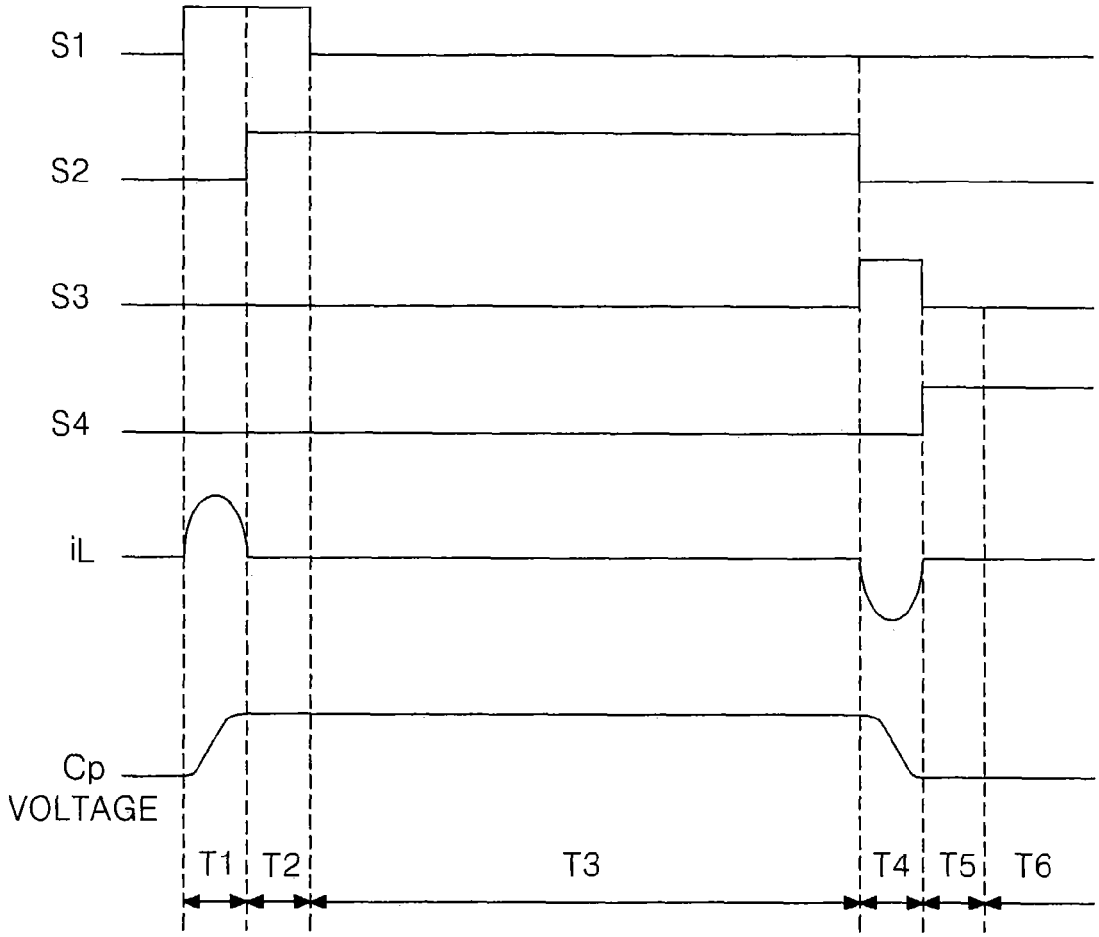
FIG. 4 RELATED ART
FIG. 4 is a timing diagram and a waveform diagram representing an ON/OFF timing of each switch shown in FIG. 2 and an output waveform of the panel capacitor.
Figure 5:
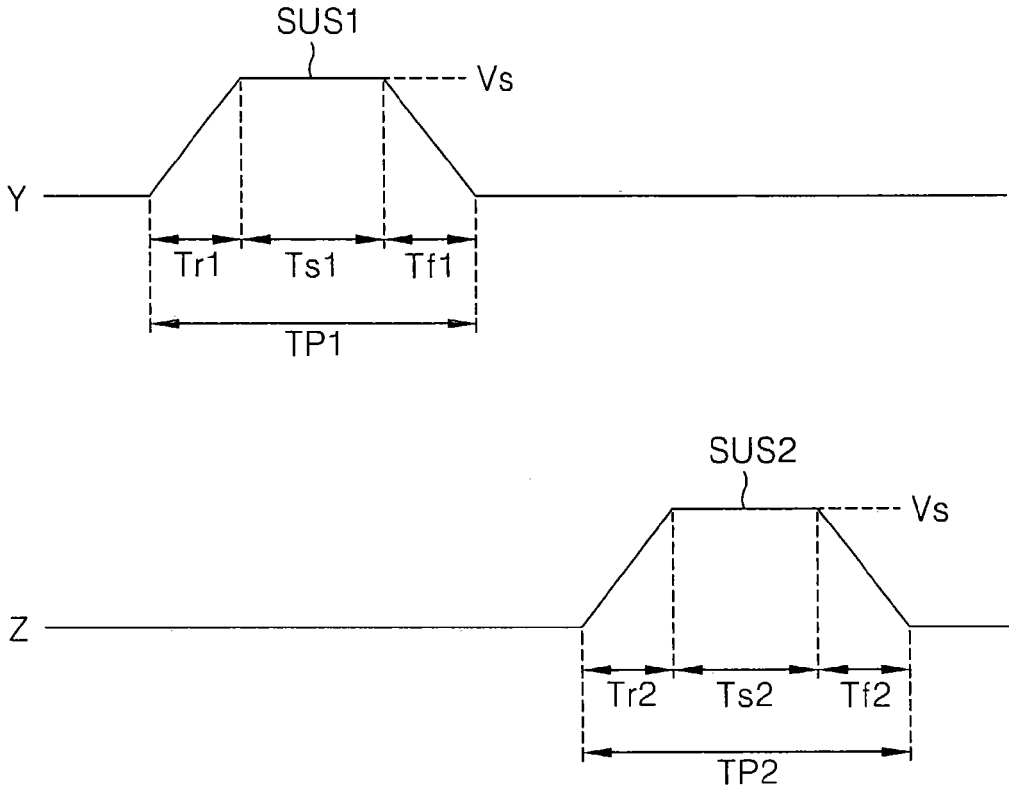
FIG.5 RELATED ART
FIG. 5 is a detailed waveform diagram of a sustain pulse applied to the sustain electrode pair shown in FIG. 2.

As shown in FIG. 8B, a rising edge Tr1 of the first sustain pulse SUS1 is longer than a rising edge Tr2 of the second sustain pulse SUS2; a sustain interval Ts1 of the first sustain pulse SUS1 is shorter than a sustain interval Ts2 of the second sustain pulse SUS2; and a falling edge Tf1 of the first sustain pulse SUS1 is identical to a falling edge Tf2 of the second sustain pulse SUS2. As a rising edge of the sustain pulse is smaller, a discharge intensity becomes relatively larger. The rising edge Tr2 of the second sustain pulse SUS2 shorter than the rising edge Tr1 of the first sustain pulse SUS1 cause relatively larger discharge intensity. Herein, the rising edges Tr1 and Tr2 mean time intervals going from an operation time of the energy recovering circuit shown in FIG. 3 until a turning-on time of the second switch S2.

Accordingly, the second sustain pulse SUS2 having a larger pulse width than the first sustain pulse SUS1 compensates for a resistance of the current path extending from the sustain driver into the sustain electrode line Z. Thus, a sustain discharge intensity between the scan electrode line Y and the sustain electrode line Z becomes equal. If the discharge intensity is equal, then a discharge becomes uniform to thereby improve a picture quality.

Referring to FIG. 7A and FIG. 7B, a width TP1 of the first sustain pulse SUS1 applied to the scan/sustain electrode line Y is larger than a width TP2 of the second sustain pulse SUS2 applied to the sustain electrode line Z.

As shown in FIG. 7A, a rising edge Tr1 of the first sustain pulse SUS1 is identical to a rising edge Tr2 of the second sustain pulse SUS2; a sustain interval Ts1 of the first sustain pulse SUS1 is longer than a sustain interval Ts2 of the second sustain pulse SUS2; and a falling edge Tf1 of the first sustain pulse SUS1 is identical to a falling edge Tf2 of the second sustain pulse SUS2.

As shown in FIG. 7B, a rising edge Tr1 of the first sustain pulse SUS1 is shorter than to a rising edge Tr2 of the second sustain pulse SUS2; a sustain interval Ts1 of the first sustain pulse SUS1 is longer than a sustain interval Ts2 of the second sustain pulse SUS2; and a falling edge Tf1 of the first sustain pulse SUS1 is identical to a falling edge Tf2 of the second sustain pulse SUS2. As a rising edge of the sustain pulse is smaller, a discharge intensity becomes relatively larger. The rising edge Tr1 of the first sustain pulse SUS1 shorter than the rising edge Tr2 of the second sustain pulse SUS2 cause relatively larger discharge intensity.

Accordingly, the first sustain pulse SUS1 having a larger pulse width than the second sustain pulse SUS2 compensates for a resistance of the current path extending from the scan driver into the scan electrode line Y. Thus, a sustain discharge intensity between the scan electrode line Y and the sustain electrode line Z becomes equal. If the discharge intensity is equal, then a discharge becomes uniform to thereby improve a picture quality.

As described above, the method of driving the plasma display panel according to the present invention differentiates rising edges and sustain intervals of the first and second sustain pulses, thereby allowing the widths of the first and second sustain pulses to be different from each other. In other words, a sustain pulse having a relatively larger pulse width is applied to the electrode line having a relatively larger resistance of the current path extending from the electrode line into the driver. Accordingly, the sustain discharge intensity between the scan electrode and the sustain electrode is equal, so that it becomes possible to prevent an excessive discharge and hence improve a driving voltage margin.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention.

Accordingly, the scope of the invention shall be determined only by the appended claims and their equivalents.

What is claimed is:

1. A method of driving a plasma display panel having first and second row electrodes and including a sustain period for implementing a gray scale, comprising:

alternately applying first and second sustain pulses having a different width during the sustain period to the first and second row electrodes, wherein widths of the first and second sustain pulses are based on a resistance between a first driver and at least one of the first row electrodes and a resistance between a second driver and at least one of the second row electrodes.

2. The method as claimed in claim 1, wherein the resistance going from the first driver generating the first sustain pulse into the at least one of the first row electrodes is different from the resistance going from the second driver generating the second sustain pulse into the at least one of the second row electrodes.

3. The method as claimed in claim 2, wherein said resistance going from the first driver into the at least one of the first row electrodes is larger than the resistance going from the second driver into the at least one of the second row electrodes.

4. The method as claimed in claim 3, wherein a width of the first sustain pulse is longer than a width of the second sustain pulse.

5. The method as claimed in claim 3, wherein the first sustain pulse is longer than the second sustain pulse.

6. The method as claimed in claim 5, wherein a rising edge caused by an energy recovering circuit of the first sustain pulse is shorter than a rising edge caused by the energy recovering circuit of the second sustain pulse.

7. The method as claimed in claim 2, wherein the resistance going from the second driver into the at least one of the second row electrodes is larger than the resistance going from the first driver into the at least one of the first row electrodes.

8. The method as claimed in claim 7, wherein a width of the second sustain pulse is longer than a width of the first sustain pulse.

9. The method as claimed in claim 7, wherein the second sustain pulse is longer than the first sustain pulse.

10. The method as claimed in claim 9, wherein a rising edge caused by an energy recovering circuit of the second sustain pulse is shorter than a rising edge caused by the energy recovering circuit of the first sustain pulse.

11. A method of driving a plasma display panel having first and second row electrodes, the method comprising:

applying first sustain pulses having a first width during a sustain period to the first row electrodes; and applying second sustain pulses having a second width during the sustain period to the second row electrodes, the first width being different from the second width, wherein the first width of the first sustain pulses and the second width of the second sustain pulses are based on a resistance between a first driver and the first row electrodes and a resistance between a second driver and the second row electrodes.

12. The method as claimed in claim 11, wherein the resistance from the first driver to the first row electrodes is different from the resistance from the second driver to the second row electrodes.

13. The method as claimed in claim 12, wherein said resistance from the first driver to the first row electrodes is larger than the resistance from the second driver to the second row electrodes.

14. The method as claimed in claim 13, wherein the first width of the first sustain pulse is wider than the second width of the second sustain pulse.

15. The method as claimed in claim 13, wherein a rising edge of the first sustain pulse is shorter than a rising edge of the second sustain pulse.

16. The method as claimed in claim 15, wherein the rising edge of the first sustain pulse and the rising edge of the second sustain pulse are based on an energy recovery circuit.

17. The method as claimed in claim 12, wherein the resistance from the second driver to the second row electrode is larger than the resistance from the first driver to the first row electrode.

18. The method as claimed in claim 17, wherein the second width of the second sustain pulse is wider than the first width of the first sustain pulse.

19. The method as claimed in claim 17, wherein a rising edge of the second sustain pulse is shorter than a rising edge of the first sustain pulse.

20. The method as claimed in claim 19, wherein the rising edge of the first sustain pulse and the rising edge of the second sustain pulse are based on an energy recovery circuit.

21. A plasma display driving method comprising:

applying a first sustain pulse to a first row electrode during a sustain period; and applying a second sustain pulse to a second row electrode during the sustain period, the first sustain pulse being different from the second sustain pulse, wherein a width of the first sustain pulse is based on a resistance from a first driver to the first row electrode, and a width of the second sustain pulse is based on a resistance from a second driver to the second row electrode.

22. The method as claimed in claim 21, wherein the first sustain pulse is longer than the second sustain pulse.

23. The method as claimed in claim 22, wherein a rising edge of the first sustain pulse is shorter than a rising edge of the second sustain pulse.

24. The method as claimed in claim 21, wherein the second sustain pulse is longer than the first sustain pulse.

* * * * *